US008262174B2

(12) United States Patent
Rahilly

(10) Patent No.: US 8,262,174 B2
(45) Date of Patent: Sep. 11, 2012

(54) MULTI-LATCH RELEASE MECHANISM

(75) Inventor: Michael Rahilly, Encinitas, CA (US)

(73) Assignee: CareFusion 303, Inc., San Diego, CA (US)

( * ) Notice: Subject to any disclaimer, the term of this patent is extended or adjusted under 35 U.S.C. 154(b) by 499 days.

(21) Appl. No.: 12/479,669

(22) Filed: Jun. 5, 2009

(65) Prior Publication Data

US 2010/0308704 A1 Dec. 9, 2010

(51) Int. Cl.
*E06B 3/50* (2006.01)

(52) U.S. Cl. ..... 312/109; 312/222

(58) Field of Classification Search ..... 312/215–218, 312/222, 209, 319.5–319.8, 109, 291, 299, 312/302, 303, 330.1; 221/123–132; 292/44–46, 292/49, 51, 52, 194, 195, 197, 199, 39, DIG. 11, 292/202

See application file for complete search history.

(56) References Cited

U.S. PATENT DOCUMENTS 4,813,753 A * 3/1989 Relyea ..... 312/291
5,087,107 A * 2/1992 Fumanelli ..... 312/333
6,011,999 A * 1/2000 Holmes ..... 700/231
6,116,461 A * 9/2000 Broadfield et al. ..... 221/98
6,327,879 B1 * 12/2001 Malsom ..... 70/97
2001/0024039 A1 * 9/2001 Lippoldt et al. ..... 292/197
2004/0108795 A1 6/2004 Meek, Jr. et al.
2006/0163977 A1 * 7/2006 Meek et al. ..... 312/218
2009/0224638 A1 * 9/2009 Weber ..... 312/209

FOREIGN PATENT DOCUMENTS

WO 9930248 A1 6/1999
WO 2007029236 A2 3/2007

* cited by examiner

*Primary Examiner* — Darnell Jayne
*Assistant Examiner* — Andres F Gallego
(74) *Attorney, Agent, or Firm* — McDermott Will & Emery LLP

(57) ABSTRACT

A drawer that includes a container and a slide assembly is described. The container includes a receptacle and a lid. The slide assembly includes a slider to move laterally along a longest axis of the slider, and an actuator, coupled to the slider, having a detent contact area. When the slider is moved in a first direction along the axis, the actuator is placed into a first orientation, relative to a latch, in which the detent contact area of the actuator engages the detent of a latch. When the actuator is coupled with the detent of the latch and the slider is moved in a second direction opposite the first direction, the actuator is placed into a second orientation, relative to the latch, in which the actuator actuates the latch, thereby decoupling a fastener from the latch and placing a lid in an open position.

15 Claims, 12 Drawing Sheets

MULTI-LATCH RELEASE MECHANISM

BACKGROUND

1. Field

The present disclosure generally relates to apparatus and methods for actuating a fastener, and particularly to releasing a fastener by horizontal movement of an actuator.

2. Description of the Related Art

It is well known in the medical community, and in particular, in hospitals, to store medications in a centralized area or station for dispensing and administering the medications to patients. These stations have often been unsecured, allowing access to unauthorized persons. Consequently, there are several risks associated with these unsecured stations, such as the wrong type or amount of medication being administered to a patient (e.g., such as when medication is taken from an incorrect container in the station), the medication being stolen, or the mixing of medications.

Securable medication dispensing cabinets that seek to address these risks often contain complex mechanics in order to lock medication containers, which both reduce the amount of space in the cabinet to store medications, and increases the manufacturing cost of the cabinet. For example, many cabinets contain complex mechanics and motors attached to the cabinets themselves, and those mechanics and motors must then be connected to a drawer in order to provide access to compartments within the drawer, thereby reducing space in the cabinet for the drawer while at the same time providing additional constraints on use of the drawer.

SUMMARY

Drawers disclosed herein, according to certain embodiments, are independent from the cabinet in which they are housed because they each include their own actuation mechanism. The actuation mechanisms are configured to actuate a low-complexity latch release mechanism that provides access to containers within the drawer. The low-complexity latch mechanisms allow for the efficient storage and dispensing of a large number of items within a given volume.

According to certain embodiments of the present disclosure, a drawer is provided. The drawer includes at least one container and a slide assembly. The at least one container includes a receptacle and a lid, coupled to the receptacle, configured for movement between an open position and a closed position configured to restrict access to the receptacle. The at least one container also includes a fastener, coupled to the lid, configured to fasten the lid to the receptacle when the lid is in the closed position. The slide assembly includes a slider configured to move laterally along a longest axis of the slider, and an actuator, coupled to the slider, having a detent contact area. The slide assembly also includes a latch, coupled to the drawer, includes a detent on an outer surface of the latch, configured to couple to the fastener, thereby maintaining the lid in the closed position. When the slider is moved in a first direction along the axis, the actuator is placed into a first orientation, relative to the latch, in which the detent contact area of the actuator is configured to engage the detent of the latch. When the actuator is coupled with the detent of the latch and the slider is moved in a second direction opposite the first direction, the actuator is placed into a second orientation, relative to the latch, in which the actuator actuates the latch, thereby decoupling the fastener from the latch and placing the lid in the open position.

According to other embodiments of the present disclosure, a cabinet is provided. The cabinet includes at least one drawer.

The at least one drawer includes at least one container and a slide assembly. The at least one container includes a receptacle and a lid, coupled to the receptacle, configured for movement between an open position and a closed position configured to restrict access to the receptacle. The at least one container also includes a fastener, coupled to the lid, configured to fasten the lid to the receptacle when the lid is in the closed position. The slide assembly includes a slider configured to move laterally along a longest axis of the slider, and an actuator, coupled to the slider, having a detent contact area. The slide assembly also includes a latch, coupled to the at least one drawer, that includes a detent on an outer surface of the latch. The latch is configured to couple to the fastener, thereby maintaining the lid in the closed position. When the slider is moved in a first direction along the axis, the actuator is placed into a first orientation, relative to the latch, in which the detent contact area of the actuator is configured to engage the detent of the latch. When the actuator is coupled with the detent of the latch and the slider is moved in a second direction opposite the first direction, the actuator is placed into a second orientation, relative to the latch, in which the actuator actuates the latch, thereby decoupling the fastener from the latch and placing the lid in the open position.

According to certain aspects of the present disclosure, a method for accessing a container in a drawer is provided. The method includes moving a slider coupled to the drawer in a first direction along a longest axis of the slider, thereby placing an actuator into a first orientation, relative to a latch, and engaging a detent contact area of the actuator with a detent of the latch by continued movement of the slider in the first direction. The method also includes moving the slider in a second direction opposite the first direction, thereby placing the actuator into a second orientation, relative to the latch, and actuating the latch with the actuator by continued movement of the slider in the second direction, thereby decoupling a fastener from the latch and providing access to the container.

According to yet further embodiments of the present disclosure, a latching system is provided. The latching system includes a slider configured to move laterally along a longest axis of the slider, an actuator, coupled to the slider, having a detent contact area, and a latch that includes a detent on an outer surface of the latch, and configured to couple to a fastener. When the slider is moved in a first direction along the axis, the actuator is placed into a first orientation, relative to the latch, in which the detent contact area of the actuator is configured to engage the detent of the latch. When the actuator is coupled with the detent of the latch and the slider is moved in a second direction opposite the first direction, the actuator is placed into a second orientation, relative to the latch, in which the actuator actuates the latch, thereby decoupling the fastener from the latch.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the discussed embodiments as claimed.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

In the following detailed description, numerous specific details are set forth to provide a full understanding of the present disclosure. It will be obvious, however, to one ordinarily skilled in the art that the embodiments of the present disclosure may be practiced without some of these specific details. In other instances, well-known structures and techniques have not been shown in detail not to obscure the disclosure.

Certain embodiments of the drawer assembly disclosed herein provide a drawer in which the mechanical assemblies configured to open containers of the drawer are coupled to the drawer and independent from the cabinet containing the drawer. Consequently, the drawer's containers are configured to be accessible without requiring use of a motor in the cabinet in which the drawer is housed. Additionally, each drawer in the cabinet is mechanically independent from another drawer, such that even if the mechanical assemblies of one drawer fail, other drawers continue to function. The mechanical assemblies are particularly advantageous for providing access to individual containers within the drawer, which limits a user to accessing one container containing one item type at a time (e.g. "single line item dispensing"). This feature has special utility in a hospital or other patient care environment, where patient safety is improved preventing a healthcare professional from accessing an incorrect or expired medication. Advantages similar to those provided in the hospital environment can be found in other applications where controlled access is provided to items due to their high value or potential inappropriate use.

Figures 1A, 1B:
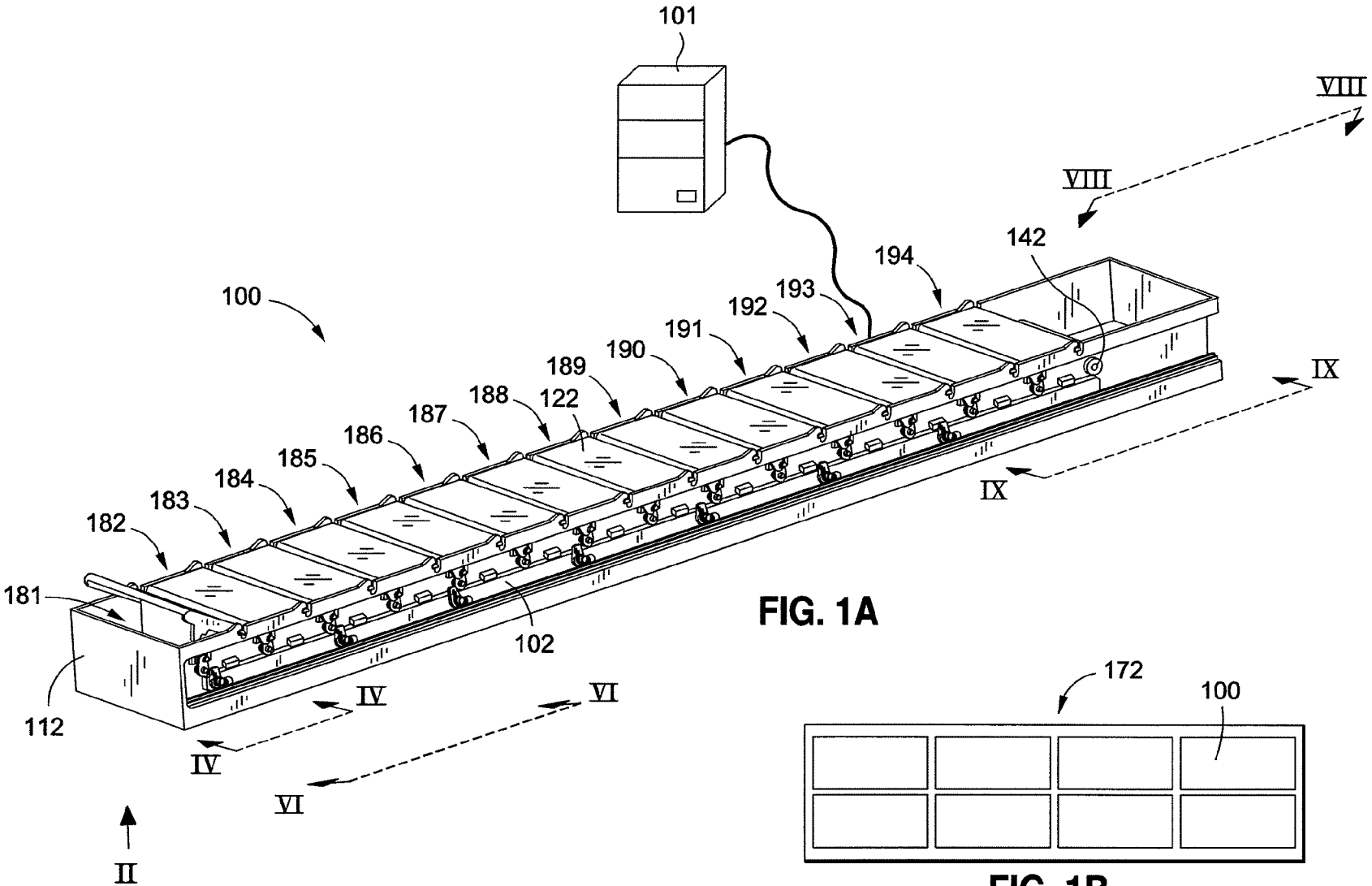
FIG. 1A illustrates a drawer according to certain embodiments.
FIG. 1B illustrates a cabinet including the drawer according to certain embodiments.

FIG. 1A illustrates a drawer 100 according to certain embodiments. The drawer 100 includes a body 112 that includes a motor 142, an actuator assembly including a slider 102, and a plurality of containers 181 to 194, each having a lid 122. The lid 122 for container 181 is illustrated in an open position. In certain embodiments, the drawer 100 is connected to a computer system 101 (e.g., when the drawer 100 is housed in a cabinet), which is described in more detail below.

The configuration of the drawer 100 is exemplary only, such that other physical configurations may be employed without departing from the scope of this disclosure. The drawer 100 is configured to be used in a cabinet 172. For example, the cabinet 172 can house a plurality of drawers 100 in any number of configurations, such as a four-wide by two-high cabinet 172 configuration illustrated in FIG. 1B. Other drawer configurations may be employed without departing from the scope of the disclosure.

Figure 2:
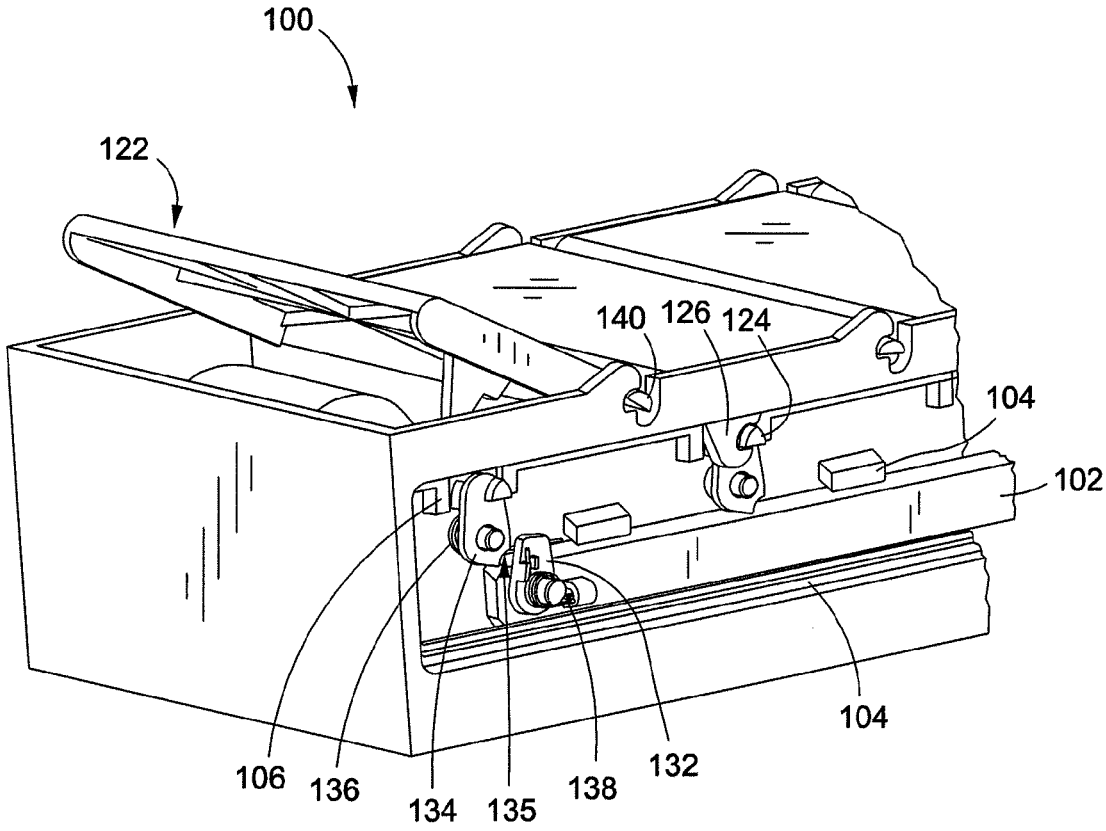
FIG. 2 is a front view of a portion of the drawer of FIG. 1A in the direction of arrow II of FIG. 1.

FIG. 2 is a front view of a portion of the drawer of FIG. 1A in the direction of arrow II of FIG. 1. The drawer 100 includes a latching system. The latching system includes a slider 102 configured to move laterally along a longest axis of the slider 102, and an actuator 132 that is pivotally coupled to the slider 102 and has a contact edge. Vertical movement of the slider 102 is constrained at least in part by placement of the slider 102 under slide retaining bosses 104. The latching system also includes a latch 134 comprising a detent 135 on an outer surface of the latch 134. Movement of the latch 134 is constrained at least in part by placement of the latch 134 proximate to stop block 106.

The actuator 132 is coupled to a spring 138 or other bias member that is biased in a direction substantially perpendicular to the longest axis of the slider 102 (e.g., spring 138 is biased vertically). The latch 134 is also coupled to a spring 136 that is biased in a direction substantially perpendicular to the longest axis of the slider 102 (e.g., spring 136 is also biased vertically). In certain embodiments, when there is substantially little or no tension on the spring 138 coupled to the actuator 132, the latch 134 and the actuator 132 are held vertically in place. The latch 134 is biased under spring tension against stop block 106.

In certain embodiments, the torsion strength of spring 136 coupled to latch 134 is greater than the torsion strength of spring 138 coupled to the actuator 132. For example, spring 136 coupled to latch 134 can have a torsion strength/rate of about 0.402 inches per pound, while spring 138 coupled to the actuator 132 can have a torsion strength/rate of about 0.125 inches per pound. In certain embodiments, other torsion strength values can be used in accordance with the configuration of the drawer 100 and the needs of the user.

As will be described in further detail below, the detent contact area 133 of the actuator 132 is configured to engage the detent 135 of the latch 134 when the slider 102 is moved in a first direction (e.g., from left to right in FIG. 2) along the axis once the latch actuator 132 is in the correct orientation, as shown below in FIG. 4F. When the actuator 132 is engaged with the detent 135 of the latch 134 and the slider 102 is moved in a second direction opposite the first direction (e.g., from right to left in FIG. 2), the actuator 132 actuates the latch 134.

The coupling of the lid 122 to the drawer 100 includes a spring 140 that biases the lid towards an open position. The lid 122, however, remains in a closed position due to the coupling of a fastener 126 of the lid 122 with a fastener interface 124 of the latch 134. The fastener interface 124 is configured to couple with the fastener 126 such as shown, or by other fastening methods. As will be illustrated later, actuation (e.g., rotation or movement) of the latch 134 by the actuator 132 causes the fastener 126 to decouple from the fastener interface 124, thereby causing the lid 122 to open due to the bias of the spring 140.

Figure 3:
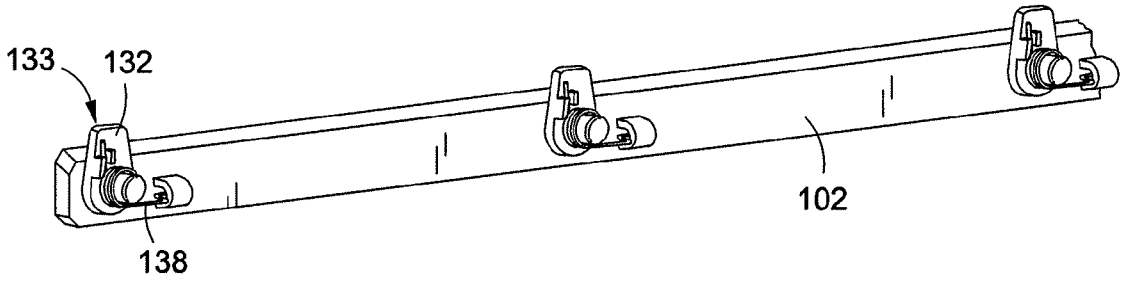
FIG. 3 is a view of an exemplary slider in isolation, from the drawer of FIG. 1A.

FIG. 3 is a view of an exemplary slider in isolation, from the drawer of FIG. 1A. The number of actuators 132 coupled to the slide 102 can vary depending on the number of latches 134 that are configured to be actuated by the actuators 132. For example, if one actuator 132 is configured to actuate two latches 134 of a drawer 100, then three actuators 132 can be coupled to the slider 102 in order to actuate the six latches 134.

Figure 4A:
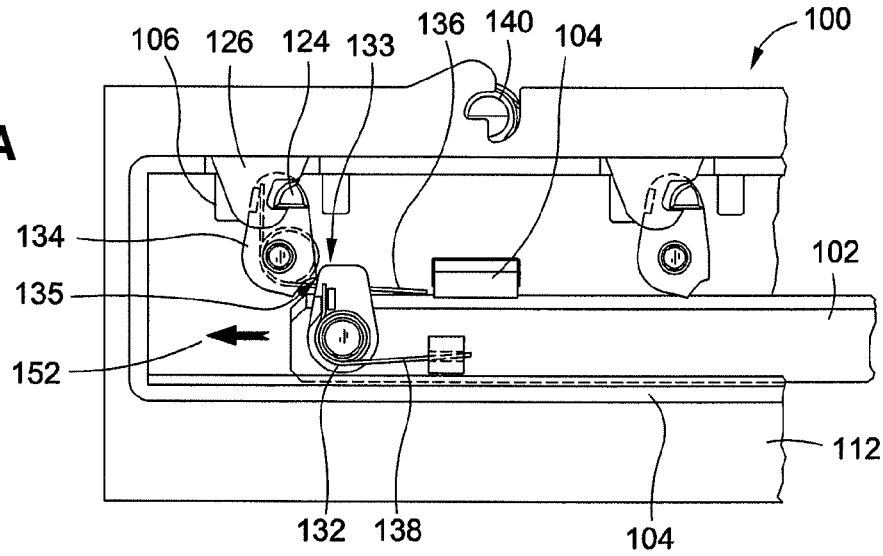
FIGS. 4A-4G illustrate, from a side view in the direction of arrow IV-IV of FIG. 1A, various stages of the slider opening a lid of a container of the drawer of FIG. 1A.
Figure 4B:
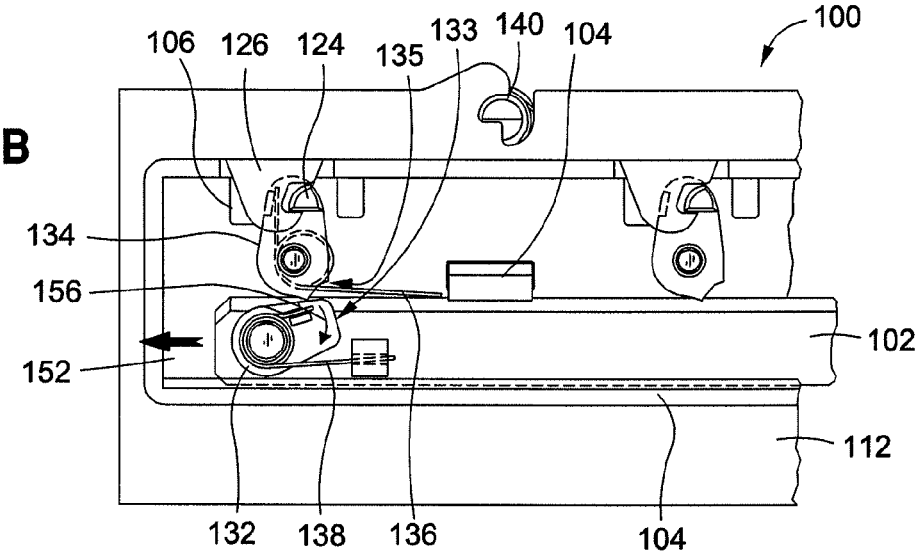
Figure 4C:
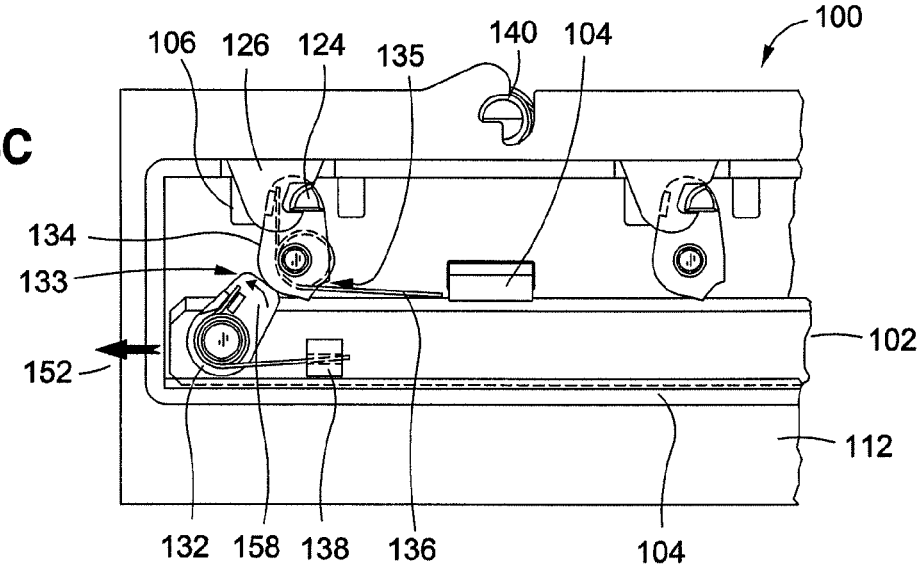
Figure 4D:
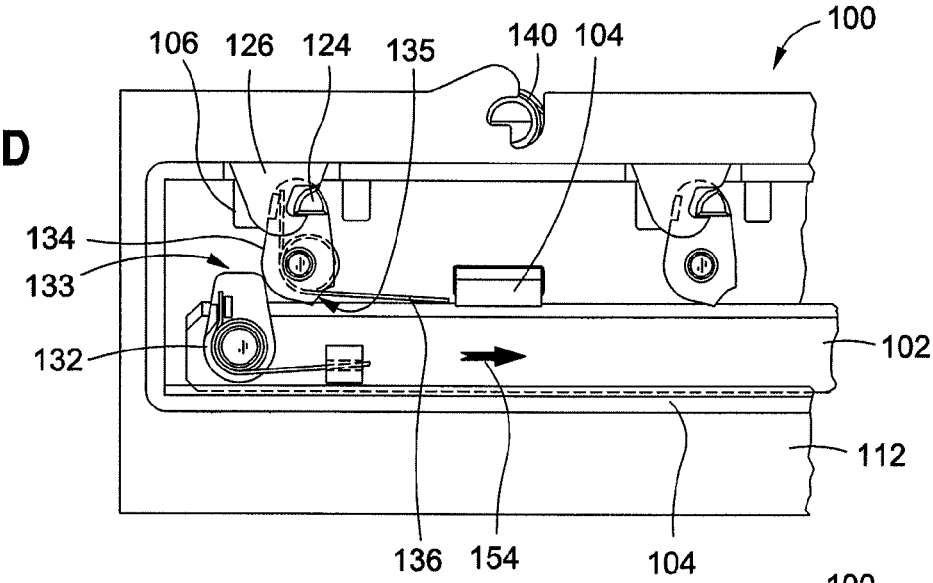
Figure 4E:
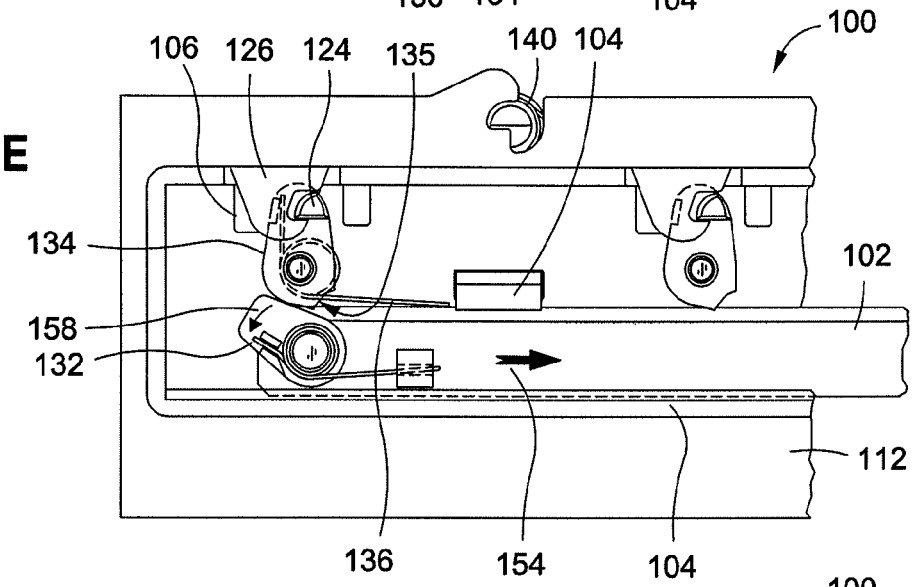
Figure 4F:
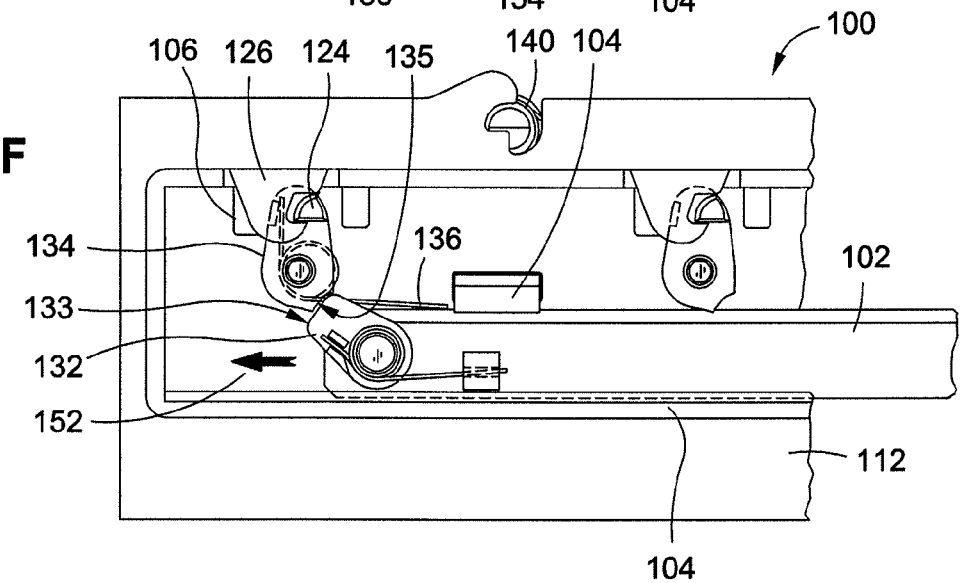

FIGS. 4A-4G illustrate, from a side view in the direction of arrow IV-IV of FIG. 1, various stages of the slider opening a lid of a container of the drawer % of FIG. 1A. In FIG. 4A, the slider 102 is moved in a direction 152 laterally towards a proximal end of the drawer 100 (e.g., from right to left) to move the detent contact area 133 of actuator 132 away from the proximal side of detent 135 of the latch 134. As illustrated in FIG. 4B, continued lateral movement of the slider 102 in the direction 152 toward the proximal end of the drawer 100 causes actuator 132 to contact the latch 134 and pivot in a clockwise direction 156, and pass under the latch 134. The latch 134 maintains its substantially vertical position due to the relatively greater tension of the spring 136 to which it is coupled in comparison to the spring 138 coupled to the actuator 132. Once a substantial portion of the actuator 132 passes under and past the latch 134, the actuator 132 begins to resume its substantially vertical or neutral position due to the torsion strength of the spring 138 to which the actuator 132 is coupled, as illustrated in FIG. 4C.

From a position in which the detent contact area 133 of the actuator 132 is on a distal side of the detent 135 of the latch 134, and closer to the proximal end of the drawer 100, as illustrated in FIG. 4D, the slider 102 is moved in a direction 154 laterally toward the distal end of the drawer 100 (e.g., from left to right), which is the direction 154 opposite to direction 152. Movement of the slider 102 in the direction 154 toward the distal end of the drawer 100 causes the actuator 132 to once again contact the latch 134, pivot in a counter-clockwise direction 158 to a different orientation, and pass under the latch 134, as illustrated in FIG. 4E. Once a substantial portion of the actuator 132 passes under and partly past the latch 134, the detent contact area 133 of the actuator 132 engages the detent 135 of latch 134, as illustrated in FIG. 4F. When the actuator 132 is engaged with the detent 135 of the latch 134, and the slider 102 is moved in the direction 152 laterally toward the proximal end of the drawer 100, the actuator 132 is configured to actuate (e.g., move or rotate) the latch 134 by applying force to the latch 134.

Figure 4G:
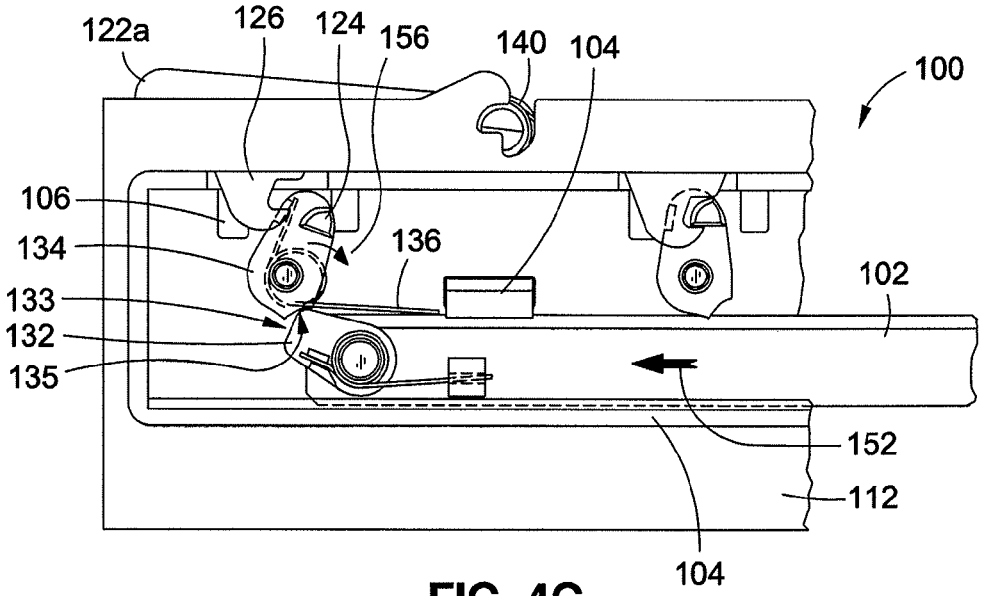

As illustrated in FIG. 4G, actuation of the latch 134 causes the latch 134 to rotate in a clockwise direction 156 as the slider is moved further in direction 152. Clockwise rotation 156 of the latch 134 causes the fastener 126 of the lid 122*a* to decouple from the fastener interface 124 of the latch 134, thereby causing the lid 122*a* to open due to the bias of the spring 140.

Figure 5:
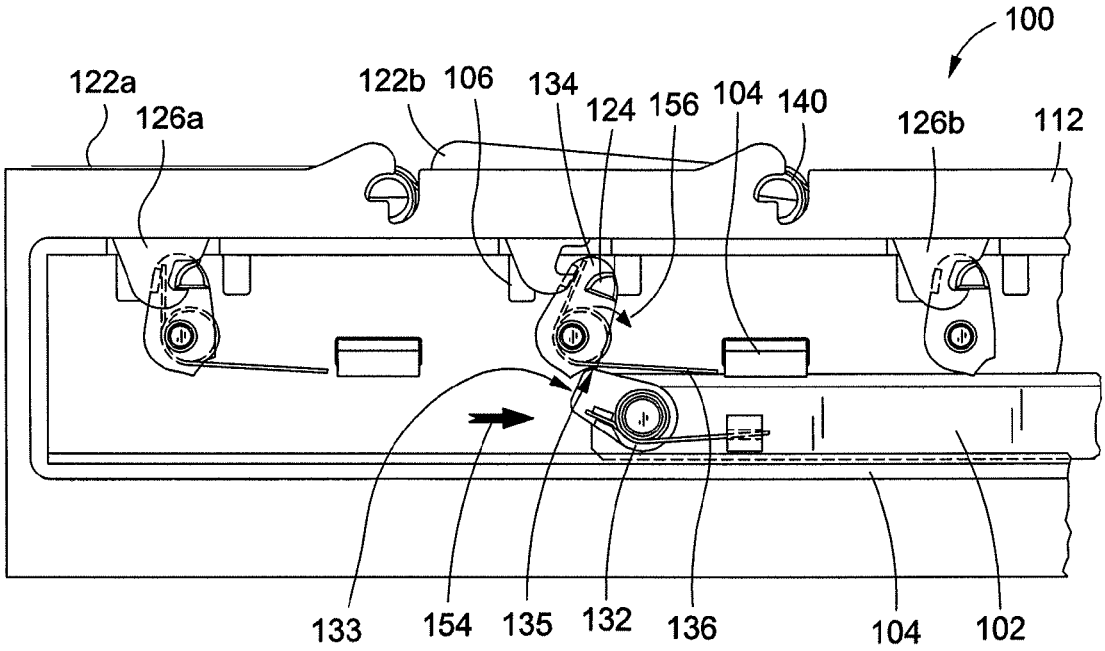
FIG. 5 illustrates, from a side view in the direction of arrow IV-IV of FIG. 1, the slider opening a lid of another container of the drawer of FIG. 1A.

FIG. 5 illustrates, from a side view in the direction of arrow IV-IV of FIG. 1, the slider 102 opening a lid 122*b* of another container of the drawer 100 of FIG. 1A. Positioning of the slider 102 and actuator 132 near the latch 134 associated with the lid 122*b* is accomplished by movement of the slider 102 in the direction 154 (for example, from the position in FIG. 4A or FIG. 4G) toward the distal end of the drawer 100 (e.g., from left to right). Similar to the configuration described with reference to FIGS. 4A-4G, once the detent contact area 133 of the actuator 132 is engaged with the detent 135 of latch 134, and the slider 102 is moved in the direction 152 (not illustrated) laterally toward the proximal end of the drawer 100, the actuator 132 is configured to actuate (e.g., move or rotate) the latch 134 by applying force to the latch 134 thereby opening the lid 122*b*. Consequently, one actuator 132 can advantageously actuate two latches 134, thereby allowing one actuator 132 to be configured to open two different lids 122*a* and 122*b*.

Figure 6:
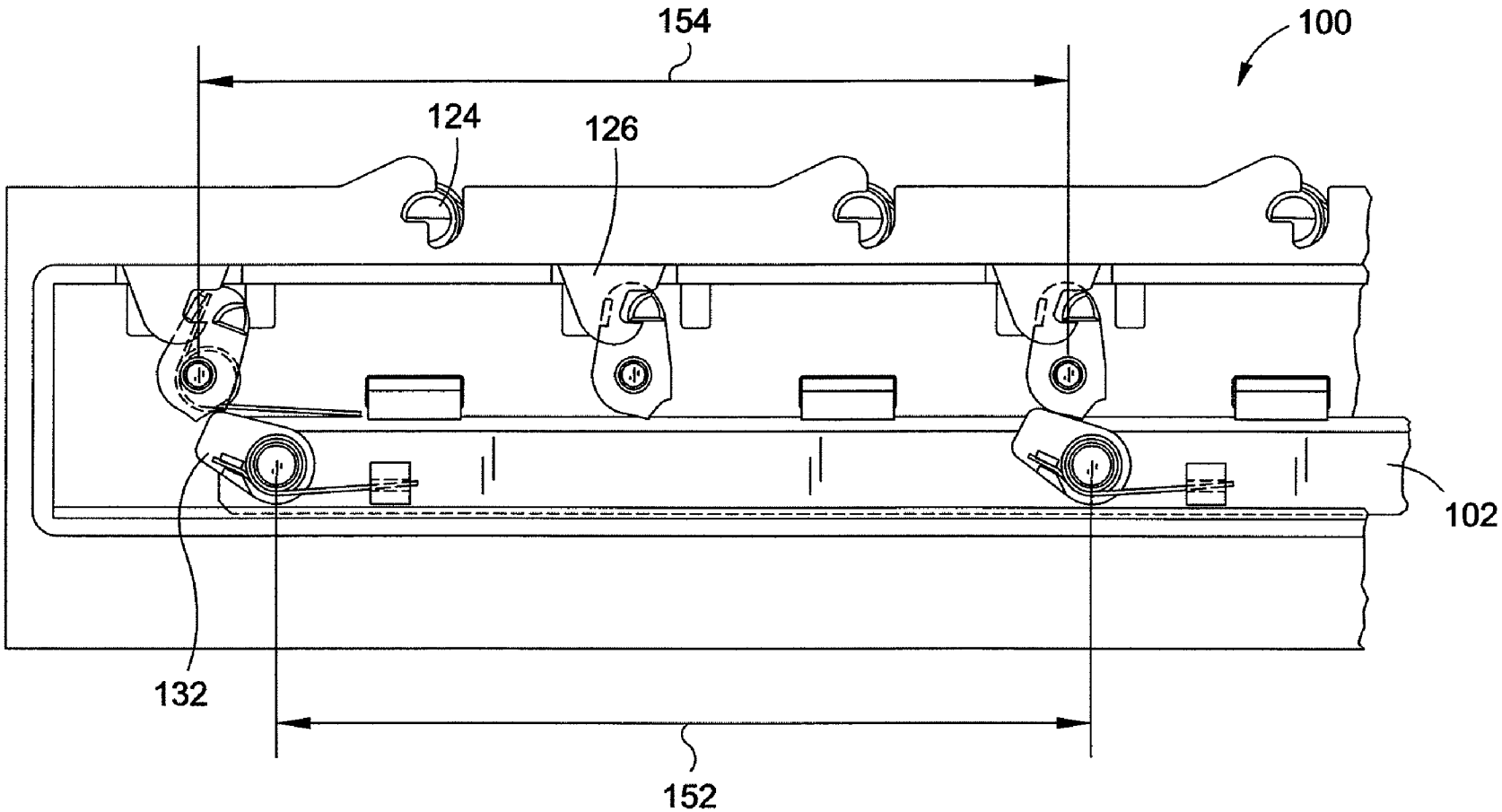
FIG. 6 illustrates, from a side view in the direction of arrow IV-IV of FIG. 1, the difference in pitches between the actuators and the latches of the drawer of FIG. 1A.

FIG. 6 illustrates, from a side view in the direction of arrow IV-IV of FIG. 1, the difference in pitches between the actuators 132 and the latches 134 of the drawer 100 of FIG. 1A. The pitch/distance 152 between the pivot points of two actuators 132 is less than the pitch/distance 154 between the latches 134 that are configured to be actuated by each of the actuators. Consequently, when one actuator 132 actuates a latch 134, another actuator 132 does not actuate another latch 134 at the same time. The pitches 152 and 154 can be provided in accordance with the latches 134 to be actuated, the size and shape of the drawer 100, and the needs of the user.

FIGS. 7A-7G illustrate, from a side view in the direction of arrow IV-IV of FIG. 1, various stages of the slider 102 opening a lid 122 of a container 181 to 194 of another embodiment of the drawer 100 of FIG. 1A. The latch 734 included in this embodiment differs from the latch 134 included in the embodiment of FIGS. 1-6 in that the latch 734 of this embodiment is configured to move laterally (e.g., from right to left) due at least in part to the coupling of the latch 734 with a spring 736 that is configured with a substantially horizontal bias force.

Figure 7A:
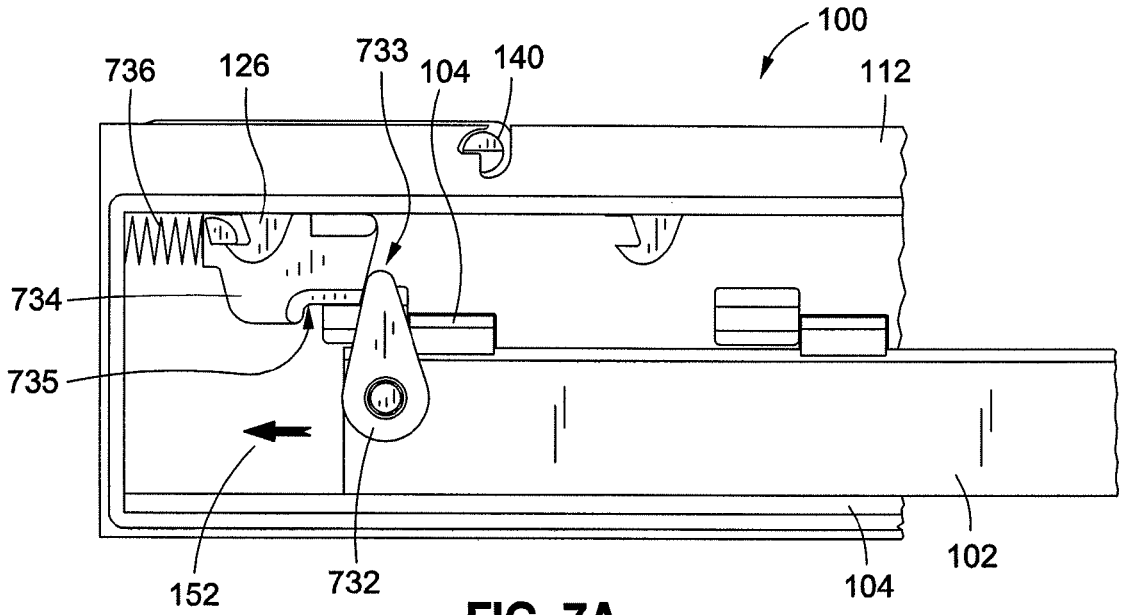
FIGS. 7A-7G illustrate, from a side view in the direction of arrow IV-IV of FIG. 1, various stages of the slider opening a lid of a container of another embodiment of the drawer of FIG. 1A.
Figure 7B:
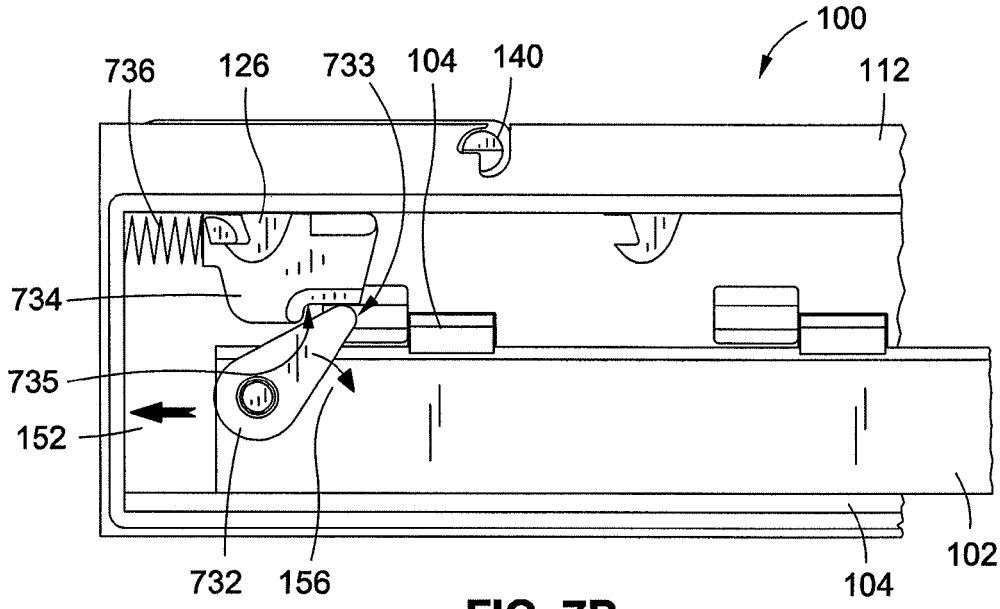
Figure 7C:
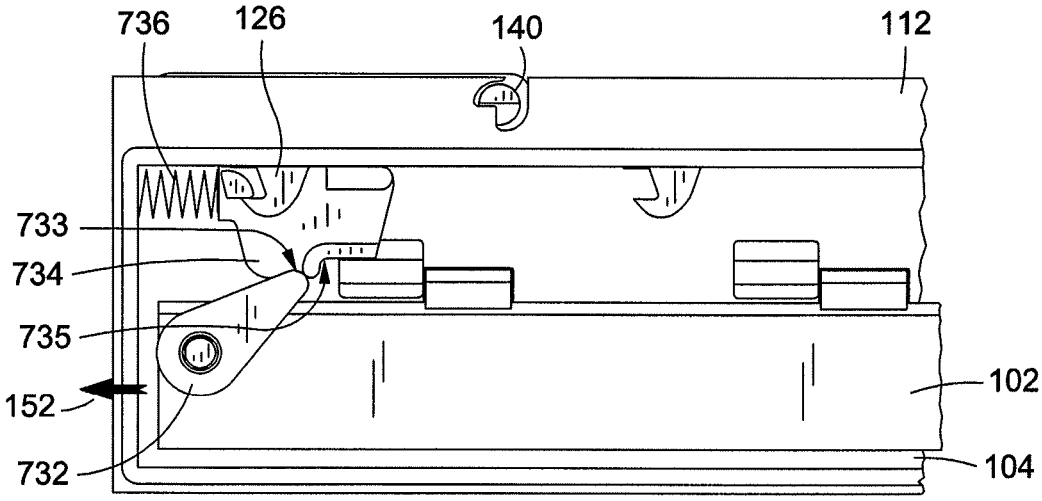

In FIG. 7A, the slider 102 is moved in the direction 152 laterally towards a proximal end of the drawer 100 (e.g., from right to left) to move the detent contact area 733 of actuator 732 away from the proximal side of detent 735 of the latch 734. As illustrated in FIG. 7B, lateral movement of the slider 102 in the direction 152 toward the proximal end of the drawer 100 causes actuator 732 to come in contact with the detent 735 of latch 734, pivot in a clockwise direction 156, and begin to pass under the detent 735 of the latch 734, while the latch 734 maintains its position due to the greater tension of the spring 736 to which it is coupled. Once a substantial portion of the actuator 732 passes under and past the detent 735 of latch 734, as illustrated in FIG. 7C, the actuator 732 begins to resume its substantially vertical or neutral position due to the torsion strength of the spring 138 to which the actuator 732 is coupled, as illustrated in FIG. 7D.

Figure 7D:
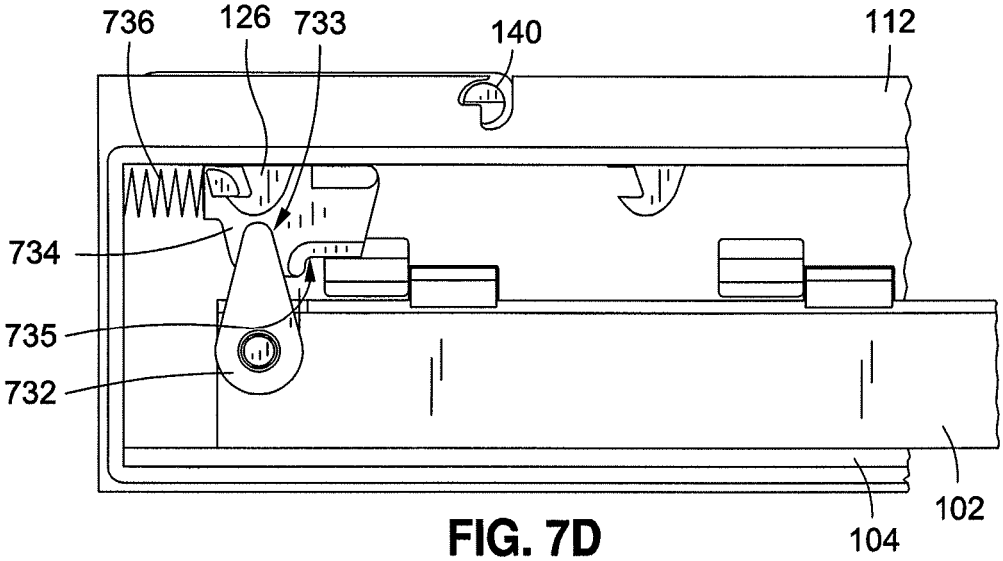
Figure 7E:
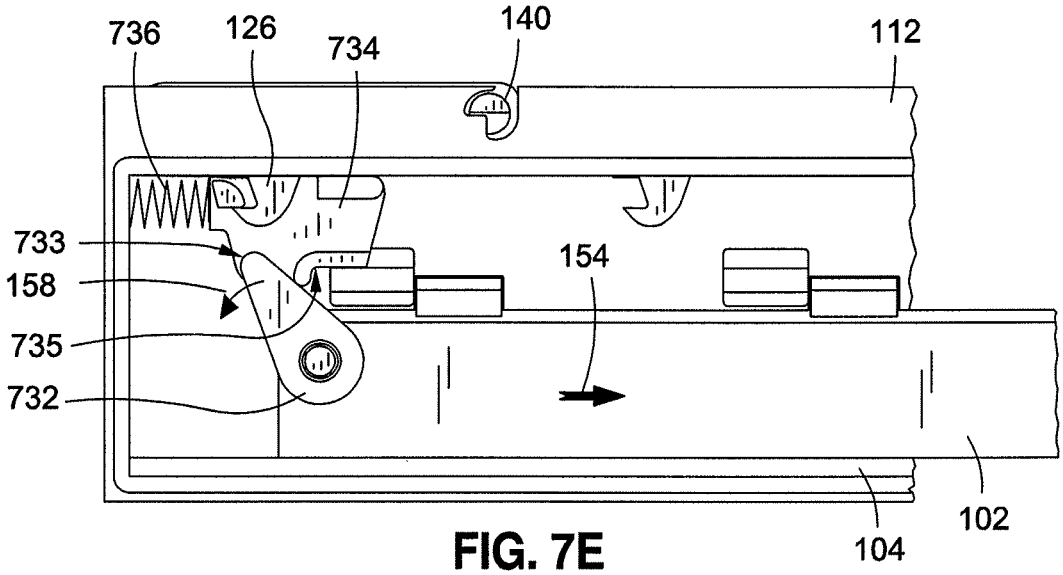
Figure 7F:
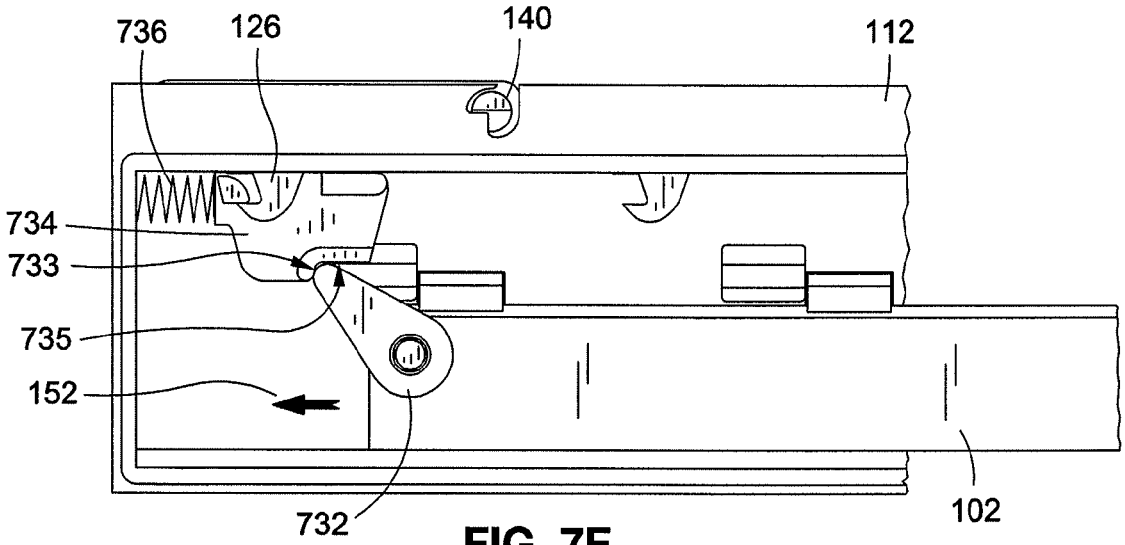

From a position in which the detent contact area 733 of the actuator 732 is on a distal side of the detent 735 of the latch 734, and closer to the proximal side of the drawer 100, as illustrated in FIG. 7D, the slider 102 is moved in the direction 154 laterally toward the distal end of the drawer 100 (e.g., from left to right), which is the direction 154 opposite to its previous direction 152. Movement of the slider 102 in the direction 154 toward the distal end of the drawer 100 causes the actuator 732 to once again contact the detent 735 of the latch 734, pivot in a counter-clockwise direction 158 to an engagement orientation, and begin to pass under the detent 735 of latch 734, as illustrated in FIG. 7E. Once a substantial portion of the actuator 732 passes under and past the latch 734, the detent contact area 733 of the actuator 732 engages the detent 735 of latch 734, as illustrated in FIG. 7F. When the actuator 732 is engaged with the detent 735 of the latch 734, and the slider 102 is moved in the direction 152 laterally toward the proximal end of the drawer 100, the actuator 732 is configured to actuate (e.g., move) the latch 734 by applying force to the latch 734.

Figure 7G:
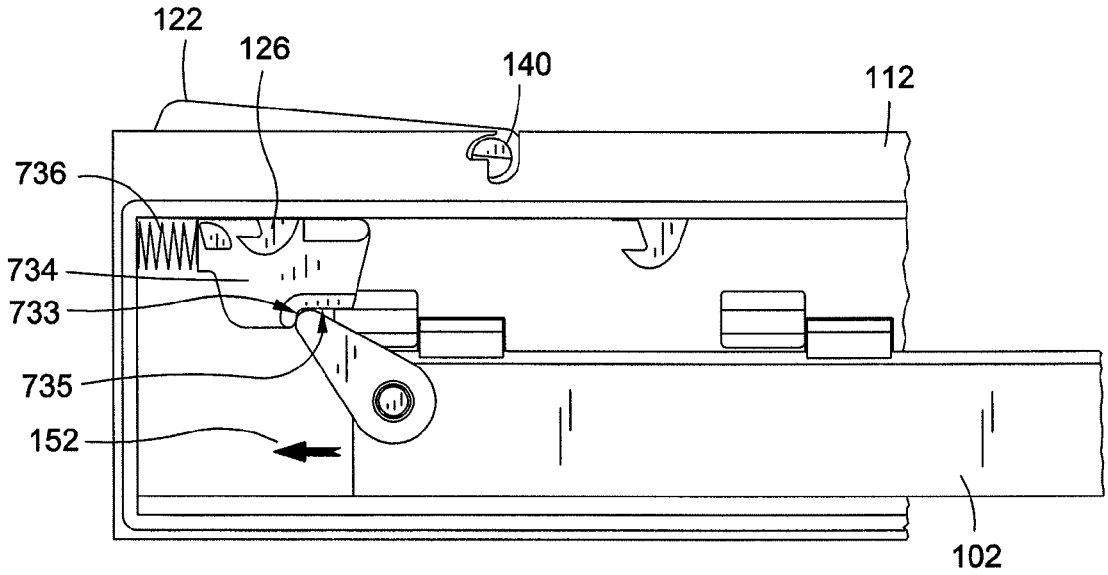

As illustrated in FIG. 7G, actuation by the actuator 732 causes the latch 734 to now move in the same lateral direction 152 (e.g., from right to left) as the slider 102. This lateral movement of the latch 734 causes the fastener 126 of the lid

122*a* to decouple from the fastener interface 124 of the latch 734, thereby causing the lid 122 to open due to the bias of the spring 140.

Figure 8:
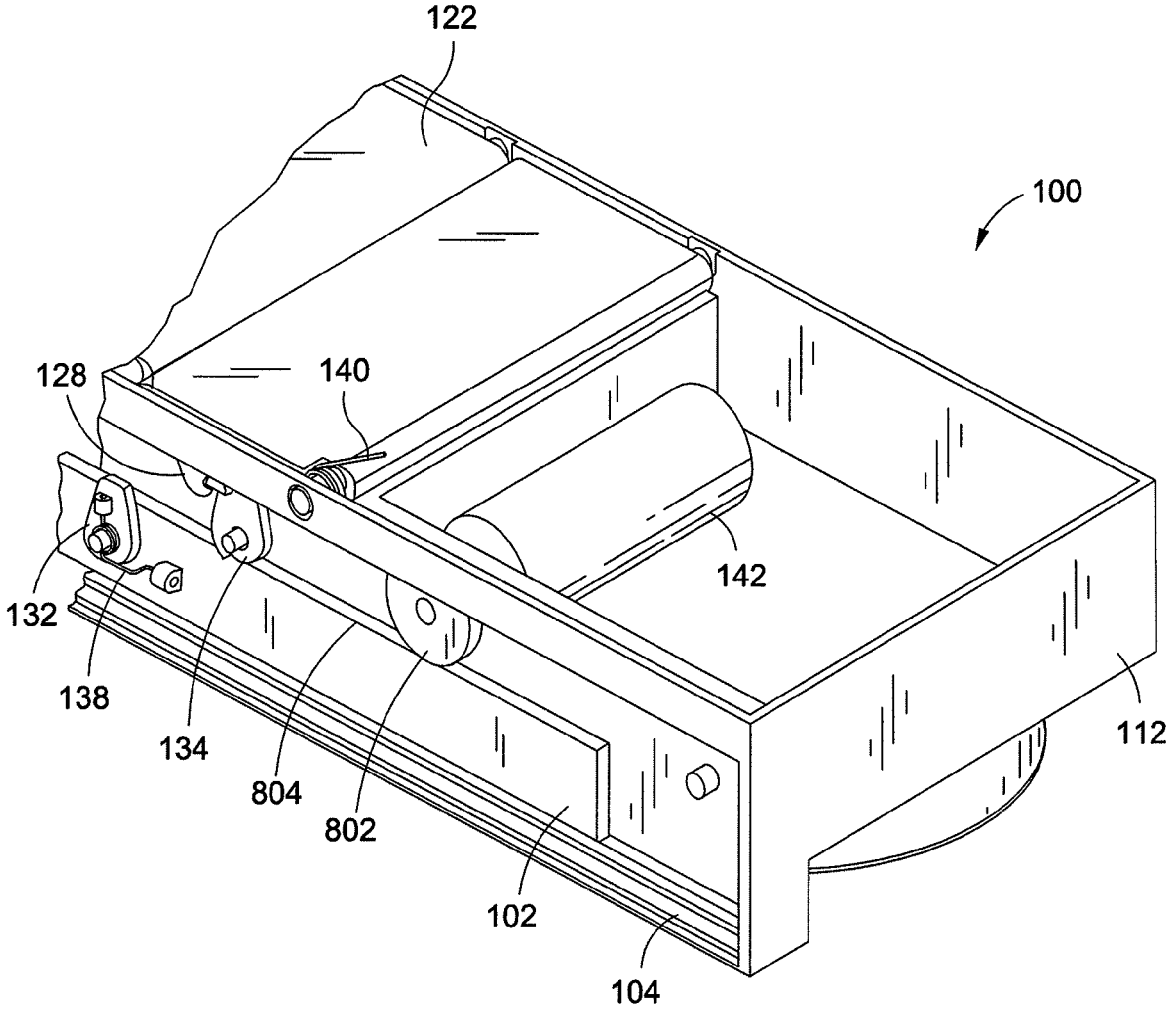
FIG. 8 illustrates a top-down view of the motor of the drawer of FIG. 1A in the direction of arrow VIII-VIII of FIG. 1.

FIG. 8 illustrates a top-down view of the motor 142 of the drawer 100 of FIG. 1A in the direction of arrow VIII-VIII of FIG. 1. The motor 142 is coupled to a pinion gear 802, and the pinion gear is coupled to a gear rack 804. The gear rack 804 is coupled to the slider 102.

Rotation of the pinion gear 802 by the motor 124 causes lateral movement of the slider 102 via the gear rack 804. As discussed above, appropriate lateral movement of the slider 102 will result in the contact edge of actuator 132 coupling with the detent 135 of the latch 134, and the actuator 132 actuating the latch 134.

The motor 124 can be controlled by the computer system 101 mentioned with reference to FIG. 1A. Specifically, the motor 124 is electronically coupled to the computer system 101, which includes a processor configured to process instructions controlling activation of the motor 124 and appropriate circuitry to interface and control the motor 124. In addition to tracking the contents of the medication cabinet 100, the computer system 101 is configured to control access to the medication cabinet by authenticating a user, such as with a bar code scanner, fingerprint reader, or other form of identification input device. The motor 124 can be activated in response to appropriate authentication of the user.

FIGS. 9A-9D illustrate, from a side view in the direction of arrow IX-IX of FIG. 1, various stages of the slider 102 triggering a drawer latch 900 of another embodiment of the drawer of FIG. 1A.

The drawer latch 900 includes a detent 904 configured to engage with a drawer latch contact area 902 on a distal end of the slider 102. The drawer latch 900 is coupled to the drawer 100 and includes a torsion spring (not illustrated) biasing the drawer latch 900 in an engaged position.

The drawer latch 900, when engaged, is configured to inhibit movement of the drawer 100. For example, an engaged drawer latch 900 can restrict the drawer 100 from moving laterally. As another example, an engaged drawer latch 900 can inhibit removal of the drawer 100 from a cabinet in which the drawer 100 is housed. When the drawer latch 900 is in a retracted position, the drawer 100 can more easily be moved laterally and removed from the cabinet in which the drawer 100 is housed.

Figure 9A:
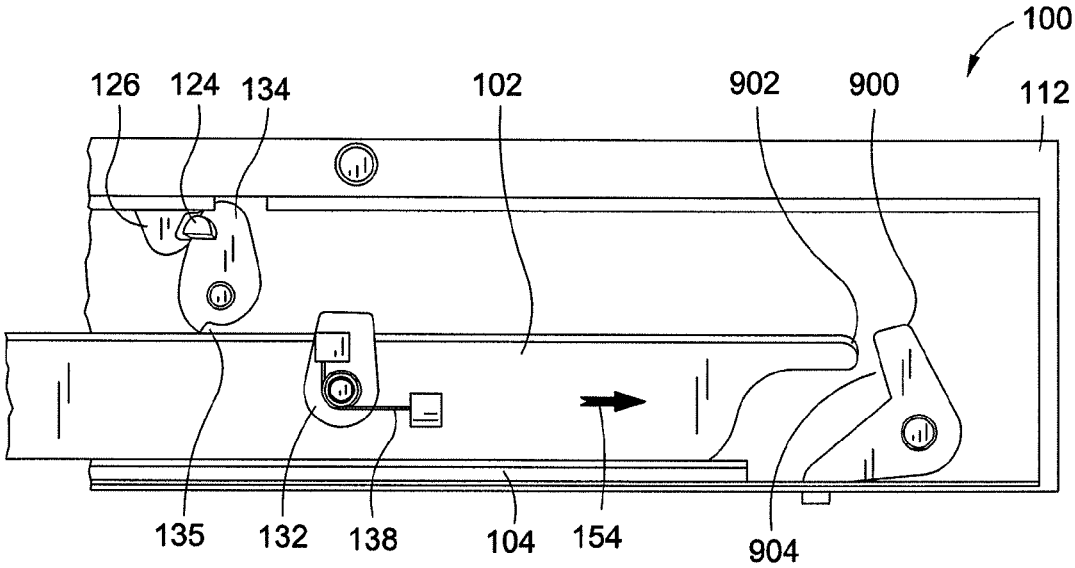
FIGS. 9A-9D illustrate, from a side view in the direction of arrow IX-IX of FIG. 1, various stages of the slider triggering a drawer actuator of another embodiment of the drawer of FIG. 1A.
Figure 9B:
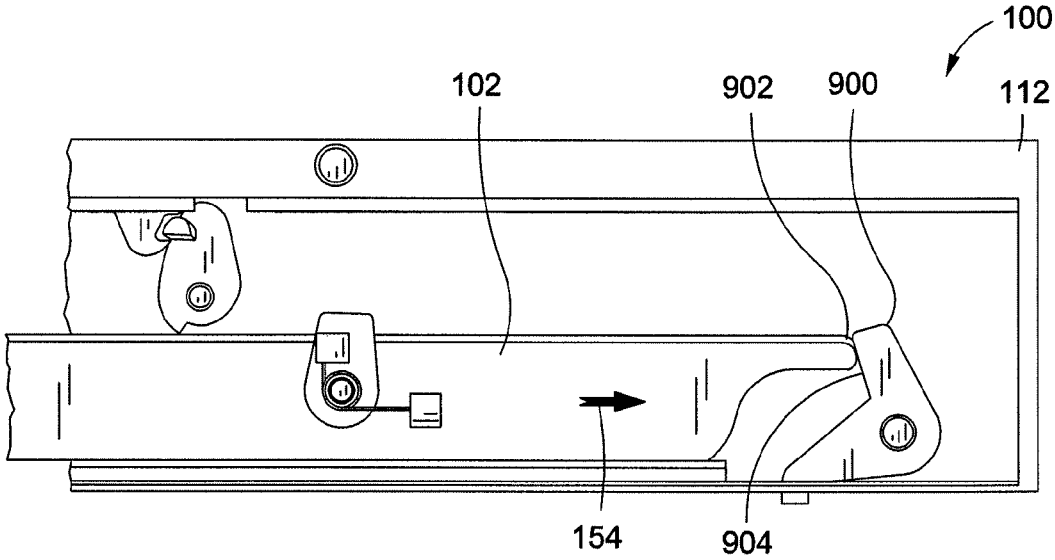
Figure 9C:
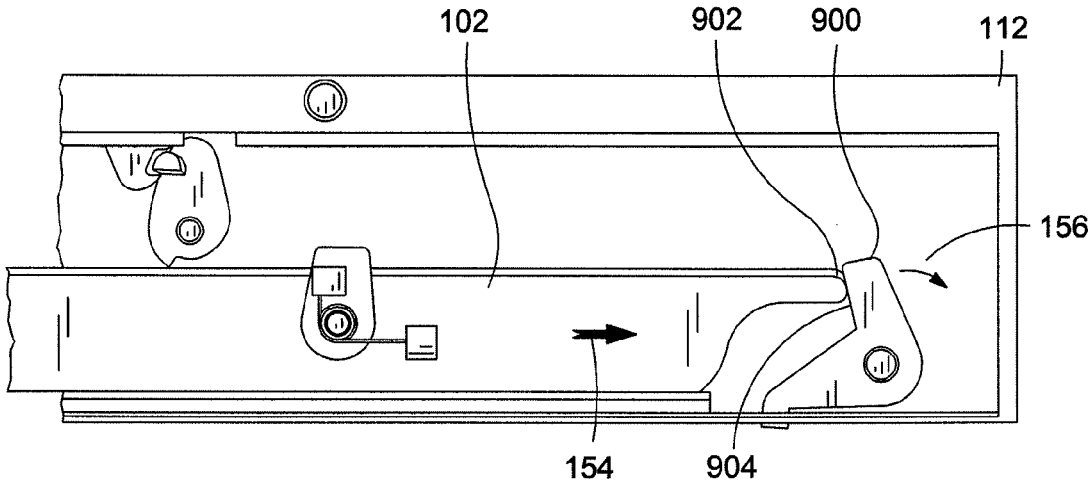
Figure 9D:
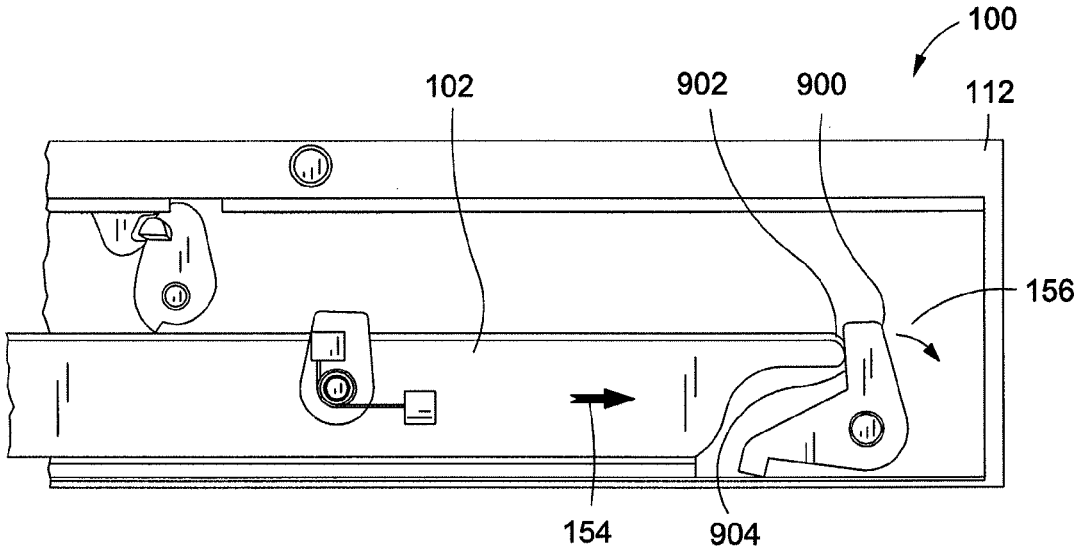

In FIG. 9A, the slider 102 is moved in a direction 154 laterally towards a distal end of the drawer 100 (e.g., from left to right) so as to move the drawer latch contact area 902 closer to the detent 904 of the drawer latch 900, which is in an engaged position. As illustrated in FIG. 9B, at an appropriate position of the slider 102, the drawer latch contact area 902 contacts the detent 904 of the engaged drawer latch 900. Upon further movement of the slider 102 in the direction 154 of the distal end of the drawer 100, the force created by the movement of the slider 102 and transferred through the drawer latch contact area 902 to the detent 904 of the engaged drawer latch 900 causes the drawer latch 900 to begin to actuate (e.g., rotate in a clockwise direction 156 about a pivot of the drawer latch 900), as illustrated in FIG. 9C. As illustrated in FIG. 9D, additional force created by yet further movement of the slider 102 in the direction 154 of the distal end of the drawer 100, is transferred through the drawer latch contact area 902 to the detent 904 of the engaged drawer latch 900, causing complete actuation of the drawer latch 900, placing the drawer latch 900 in a retracted state.

While certain aspects and embodiments of the invention have been described, these have been presented by way of example only, and are not intended to limit the scope of the invention. Indeed, the novel methods and systems described herein may be embodied in a variety of other forms without departing from the spirit thereof. The accompanying claims and their equivalents are intended to cover such forms or modifications as would fall within the scope and spirit of the invention.

What is claimed is:

1. A drawer comprising:

at least one container, comprising:

a receptacle;

a lid, coupled to the receptacle, and configured for movement between an open position and a closed position configured to restrict access to the receptacle;

a fastener, coupled to the lid, and configured to fasten the lid to the receptacle when the lid is in the closed position; and a slide assembly comprising:

a slider configured to move laterally along a longest axis of the slider;

an actuator, coupled to the slider, and having a detent contact area; and a latch, coupled to the drawer, comprising a detent on an outer surface of the latch, and configured to couple to the fastener, thereby maintaining the lid in the closed position, wherein, when the slider is moved in a first direction along the axis, the actuator is placed into a first orientation, relative to the latch, in which the detent contact area of the actuator is configured to engage the detent of the latch, and wherein, when the actuator is coupled with the detent of the latch and the slider is moved in a second direction opposite the first direction, the actuator is placed into a second orientation, relative to the latch, in which the actuator actuates the latch by applying a force from the actuator against the detent of the latch, thereby decoupling the fastener from the latch and placing the lid in the open position.

2. The drawer of claim 1, further comprising:

a second latch comprising a detent on an outer surface of the second latch, wherein the detent contact area of the actuator is configured to engage the detent of the second latch when the slider is moved in the first direction, and wherein, when the actuator is coupled with the detent of the second latch and the slider is moved in the second direction, the actuator is configured to actuate the second latch.

3. The drawer of claim 1, further comprising:

a second actuator comprising a contact edge; and a second latch, coupled to the drawer, comprising a detent on an outer surface of the second latch, wherein the actuator and the second actuator are coupled to the slider at a first pitch, wherein the latch and the second latch are coupled to the drawer at a second pitch different than the first pitch, wherein the contact edge of the second actuator is configured to engage the detent of the second latch when the slider is moved in the first direction, and wherein, when the second actuator is coupled with the detent of the second latch and the slider is moved in the second direction opposite the first direction, the second actuator is configured to actuate the second latch.

4. The drawer of claim 3, wherein the first pitch and the second pitch cause the actuator to engage the detent of the latch, and the second actuator to engage the detent of the second latch, at different lateral positions along the longest axis of the slider.

5. The drawer of claim 1, wherein the actuator comprises a bias member comprising a first torsion strength, and wherein the latch comprises a second bias member comprising a second torsion strength greater than the first torsion strength.

6. The drawer of claim 5, wherein both the bias member and the second bias member are biased in a direction substantially perpendicular to the longest axis.

7. The drawer of claim 5, wherein the bias member is biased in the first direction, and the second bias member is biased in a direction substantially perpendicular to the longest axis.

8. The drawer of claim 1, further comprising a gear configured to move the slider along the longest axis.

9. A cabinet comprising:

at least one drawer, comprising at least one container, the at least one container comprising:

a receptacle;

a lid, coupled to the receptacle, and configured for movement between an open position and a closed position configured to restrict access to the receptacle;

a fastener, coupled to the lid, and configured to fasten the lid to the receptacle when the lid is in the closed position; and a slide assembly comprising:

a slider configured to move laterally along a longest axis of the slider;

an actuator, coupled to the slider, and having a detent contact area; and a latch, coupled to the at least one drawer, comprising a detent on an outer surface of the latch, and configured to couple to the fastener, thereby maintaining the lid in the closed position, wherein, when the slider is moved in a first direction along the axis, the actuator is placed into a first orientation, relative to the latch, in which the detent contact area of the actuator is configured to engage the detent of the latch, and wherein, when the actuator is coupled with the detent of the latch and the slider is moved in a second direction opposite the first direction, the actuator is placed into a second orientation, relative to the latch, in which the actuator actuates the latch by applying a force from the actuator against the detent of the latch, thereby decoupling the fastener from the latch and placing the lid in the open position.

10. The cabinet of claim 9, further comprising:

a drawer release actuator, coupled to the at least one drawer, and configured to couple the at least one drawer to the cabinet when the drawer release actuator is in an engaged position, wherein the slider comprises a first end and a second end, wherein the actuator is coupled to the first end of the slider, wherein the second edge of the slider is configured to engage the drawer release actuator, and wherein, when the second edge of the slider is engaged with the drawer release actuator, the drawer release actuator is actuated by movement of the slider in the first direction thereby placing the drawer release actuator in a retracted position decoupling the drawer from the cabinet.

11. The cabinet of claim 9, wherein the at least one drawer comprises a motor configured to move the slider laterally along the longest axis.

12. A method for accessing a container in a drawer, comprising:

moving a slider coupled to the drawer in a first direction along a longest axis of the slider, thereby placing an actuator into a first orientation, relative to a latch;

engaging a detent contact area of the actuator with a detent of the latch by continued movement of the slider in the first direction;

moving the slider in a second direction opposite the first direction, thereby placing the actuator into a second orientation, relative to the latch;

actuating the latch with the actuator by applying a force from the actuator against the detent of the latch by continued movement of the slider in the second direction, thereby decoupling a fastener from the latch and providing access to the container.

13. The method of claim 12, wherein actuation of the latch with the actuator provides access to the container while maintaining restricted access to another container in the drawer.

14. The method of claim 12, wherein when the detent of the latch engages the detent contact area of the actuator, the slider is in a first slider position, the method further comprising:

moving the slider in the first direction along the longest axis, thereby placing the actuator into the first orientation, relative to another latch;

engaging the detent contact area of the actuator with a detent of another latch by continued movement of the slider in the first direction;

moving the slider in a second direction opposite the first direction, thereby placing the slider in a second slider position and the actuator into the second orientation, relative to the another latch;

actuating the another latch with the actuator by continued movement of the slider in the second direction, thereby decoupling another fastener from the another latch and providing access to another container.

15. A latching system comprising:

a slider configured to move laterally along a longest axis of the slider;

an actuator, coupled to the slider, and having a detent contact area; and a latch, comprising a detent on an outer surface of the latch, and configured to couple to a fastener, wherein, when the slider is moved in a first direction along the axis, the actuator is placed into a first orientation, relative to the latch, in which the detent contact area of the actuator is configured to engage the detent of the latch, and wherein, when the actuator is coupled with the detent of the latch and the slider is moved in a second direction opposite the first direction, the actuator is placed into a second orientation, relative to the latch, in which the actuator actuates the latch by applying a force from the actuator against the detent of the latch, thereby decoupling the fastener from the latch.

* * * * *